US008169255B2

(12) United States Patent
Chang et al.

(10) Patent No.: US 8,169,255 B2
(45) Date of Patent: May 1, 2012

(54) OFFSET CANCELLATION CURRENT MIRROR AND OPERATING METHOD THEREOF

(75) Inventors: Meng-Fan Chang, Taichung (TW); Shin-Jang Shen, Hsin-Chu (TW); Chia-Chi Liu, Taipei (TW)

(73) Assignee: National Tsing Hua University, Hsinchu (TW)

( * ) Notice: Subject to any disclaimer, the term of this patent is extended or adjusted under 35 U.S.C. 154(b) by 66 days.

(21) Appl. No.: 12/873,291

(22) Filed: Aug. 31, 2010

(65) Prior Publication Data

US 2012/0049921 A1 Mar. 1, 2012

(51) Int. Cl.
*G05F 1/10* (2006.01)

(52) U.S. Cl. ..... 327/538

(58) Field of Classification Search ..... 323/315, 323/316, 317; 327/538, 543
See application file for complete search history.

(56) References Cited

U.S. PATENT DOCUMENTS 6,014,020 A * 1/2000 Kuttner ..... 323/317
7,800,418 B2 * 9/2010 Imai ..... 327/132

* cited by examiner

*Primary Examiner* — Jeffrey Zweizig
(74) *Attorney, Agent, or Firm* — WPAT, P.C.; Anthony King

(57) ABSTRACT

The present invention discloses an offset cancellation current mirror and method thereof. The offset cancellation current minor comprises a first current mirror, a second current minor, switches and resistors. The first current minor comprises two transistors and a capacitance, the capacitance is used to store an electrical potential difference when the switches are turned on in ways of connecting the first current mirror with the resistor. When the switches is turned off in ways of disconnecting the first current mirror with the resistor and connecting the first current mirror with the second current minor, the electrical potential difference stored in the capacitance is used to correct the difference of the two transistors due to manufacture process.

10 Claims, 3 Drawing Sheets

OFFSET CANCELLATION CURRENT MIRROR AND OPERATING METHOD THEREOF

BACKGROUND OF THE INVENTION

1. Field of the Invention

The exemplary embodiment(s) of the present invention relates to a field of offset cancellation current minor and an operating method thereof. More specifically, the exemplary embodiment(s) of the present invention relates to an offset cancellation current mirror and an operating method thereof of cancelling the offset voltage between a current mirror pair.

2. Description of Related Art

As is well known in the art, the current minor offers an accurate reproduction of the reference based on the fine distinction between the reference current and the corresponding current. The magnitude of the offset voltages is inversely proportional to the scale of the respective transistor. The smaller the transistor, the larger the offset voltage. However, the improvement of the manufacture technology contributes to the smaller scale of the transistor. Thus, the request of the stable current in the current minor and the yield rate of semiconductor manufacture procedure are the urgent problems to be solved.

SUMMARY OF THE INVENTION

In view of the aforementioned problems of the prior art, one objective of the present invention is to provide an offset cancellation current minor and operating method thereof to cancel the distinction between the reference current and the corresponding current.

According to the objective, the present invention provides an offset cancellation current minor comprising a first current mirror, a first resistor, a second resistor, and a second current minor. The first current comprises a first reference current input terminal, a first reference current output terminal, a first corresponding current input terminal, a first corresponding current output terminal, a first transistor, a second transistor, a first switch, a second switch, a first capacitor and a second capacitor.

The first switch is connected between the gate of the first transistor and the drain of the first transistor. The second switch is connected between the gate of the second transistor and the drain of the second transistor. The first capacitor is connected between the drain of the first transistor and the gate of the second transistor. The second capacitor is connected between the gate of the first transistor. The drain of the first transistor, the source of the first transistor and the drain of the first transistor are connected to the first reference current input terminal and the first reference current output terminal respectively, and the source of the second transistor and the drain of the second transistor are connected to the first corresponding current input terminal and the first corresponding current output terminal respectively.

The third switch has a first lower access point and a first upper access point connected to the first reference current output terminal. The fourth switch has a second lower access point and a second upper access point connected to the first corresponding current output terminal. The first resistor is connected between the first lower access point of the third switch and a grounding terminal. The second resistor is connected between the second lower access point of the fourth switch and the grounding terminal. The fifth switch has a third lower access point and a third upper access point connected to the first reference current output terminal. The sixth switch has a fourth lower access point and a fourth upper access point connected to the first corresponding current output terminal. The second current minor comprises a second reference current input terminal, a second reference current output terminal, a second corresponding current input terminal, a second corresponding output terminal, a third transistor and a fourth transistor. The gate of the third transistor is connected to the gate of the fourth transistor and the drain of the third transistor. The second reference current input terminal is connected to the source of the third transistor and the third lower access point of the fifth switch. The second corresponding current input terminal is connected to the source of the fourth transistor and the fourth lower access point of the sixth switch.

According to the objective, the present invention provides an operating method of offset cancellation current minor comprising the following steps. Firstly, a first minor current mirror is provided, and the first mirror current comprises a first reference current input terminal, a first reference current output terminal, a first corresponding current input terminal, a first corresponding current output terminal, a first transistor, a second transistor, a first capacitor and a second capacitor. The first switch is connected between the gate of the first transistor and the drain of the first transistor. The second switch is connected between the gate of the second transistor and the drain of the second transistor. The first capacitor is connected between the drain of the first transistor and the gate of the second transistor. The second capacitor is connected between the gate of the first transistor and the drain of the first transistor. The source of the first transistor and the drain of the first transistor are connected to the first reference current input terminal and the first reference current output terminal respectively. The source of the second transistor and the drain of the second transistor are connected to the first corresponding current input terminal and the first corresponding current output terminal respectively.

Provide a third switch connected between the first reference current output terminal and a first resistor, and provide a fourth switch connected between the first corresponding current the a second resistor.

Provide a second current minor comprising a second reference current input terminal, a second reference current output terminal, a second corresponding current input terminal, a second corresponding output terminal, a third transistor and a fourth transistor. The gate of the third transistor is connected to the gate of the fourth transistor and the drain of the third transistor. The second reference current input terminal is connected to the source of the third transistor. The second corresponding current input terminal is connected to the source of the fourth transistor.

Connect a fifth switch between the first reference current output terminal and the second reference current input terminal, and connect a sixth switch between the first corresponding current output terminal and the second corresponding current terminal.

Switch on the first switch, the second switch, the third switch and the fourth switch and switch off the fifth switch and sixth switch to inject a reference current into the first resistor through the first transistor and to inject a corresponding current into the second resistor through the second transistor for generating a potential difference between two nodes of the first capacitor.

Switch on the fifth switch and the sixth switch and switch off the first switch, the second switch, the third switch and the fourth switch to force the reference current flowing through the first transistor and the third transistor and to force the corresponding current flowing through the second transistor and the fourth transistor for maintaining the same voltage difference value of the first capacitor and the drain of the first transistor to keep the same potential difference.

As described above, the offset cancellation current minor and operating method thereof according the present invention may have the following advantages:

The offset cancellation current minor and operating method thereof may store the potential difference by the first capacitor to calibrate the manufacture inaccuracy of the current mirror. The smaller scale of the transistors, the influence due to the current distinction may increase. The influence may be decreased effectively by the present invention.

BRIEF DESCRIPTION OF THE DRAWINGS

The exemplary embodiment(s) of the present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

Exemplary embodiments of the present invention are described herein in the context of an offset cancellation current minor and the operating method thereof.

Those of ordinary skilled in the art will realize that the following detailed description of the exemplary embodiment (s) is illustrative only and is not intended to be in any way limiting. Other embodiments will readily suggest themselves to such skilled persons having the benefit of this disclosure. Reference will now be made in detail to implementations of the exemplary embodiment(s) as illustrated in the accompanying drawings. The same reference indicators will be used throughout the drawings and the following detailed description to refer to the same or like parts.

Figure 1:
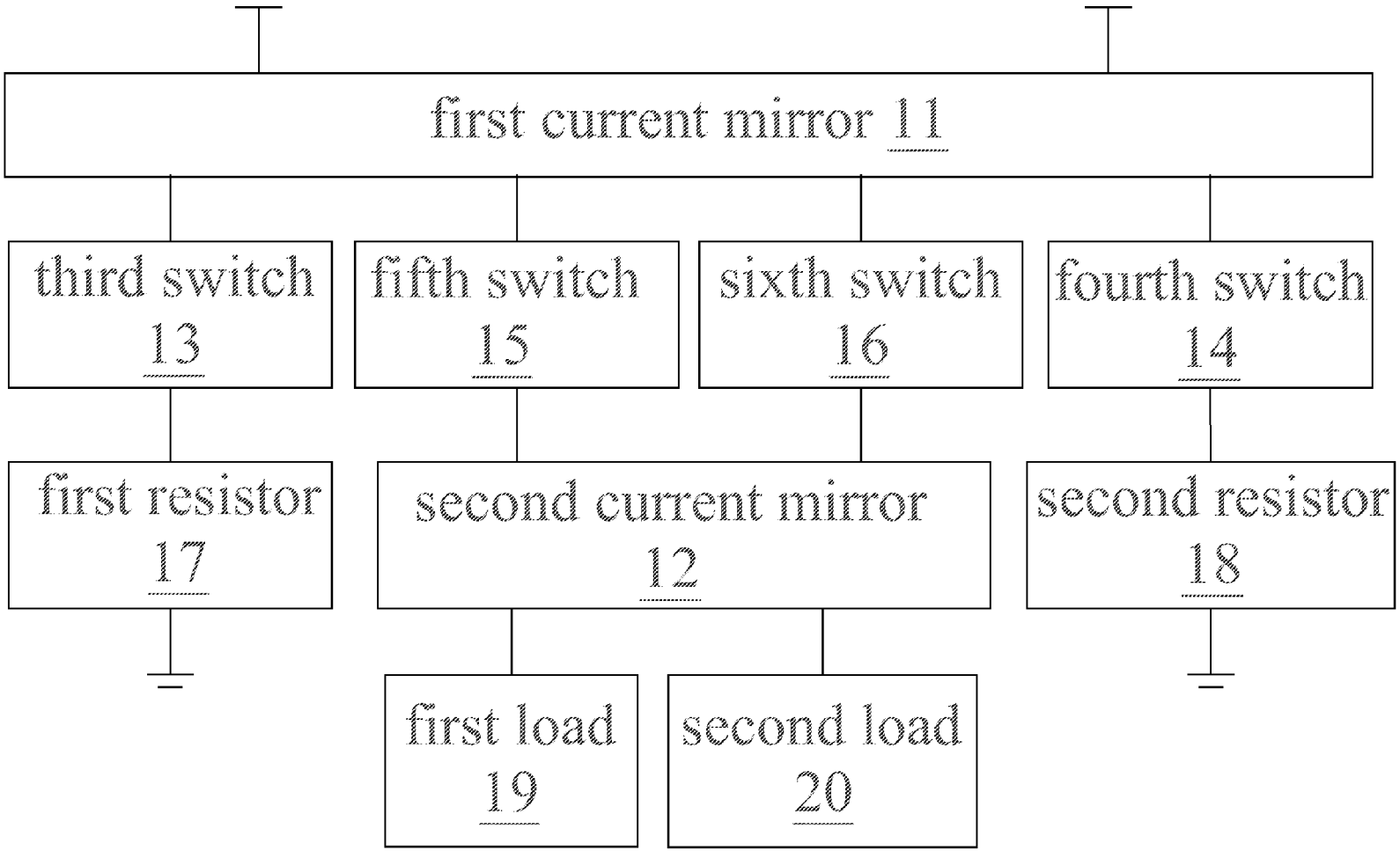
FIG. 1 illustrates a schematic diagram of an offset cancellation current mirror in accordance with the present invention.
Figure 2:
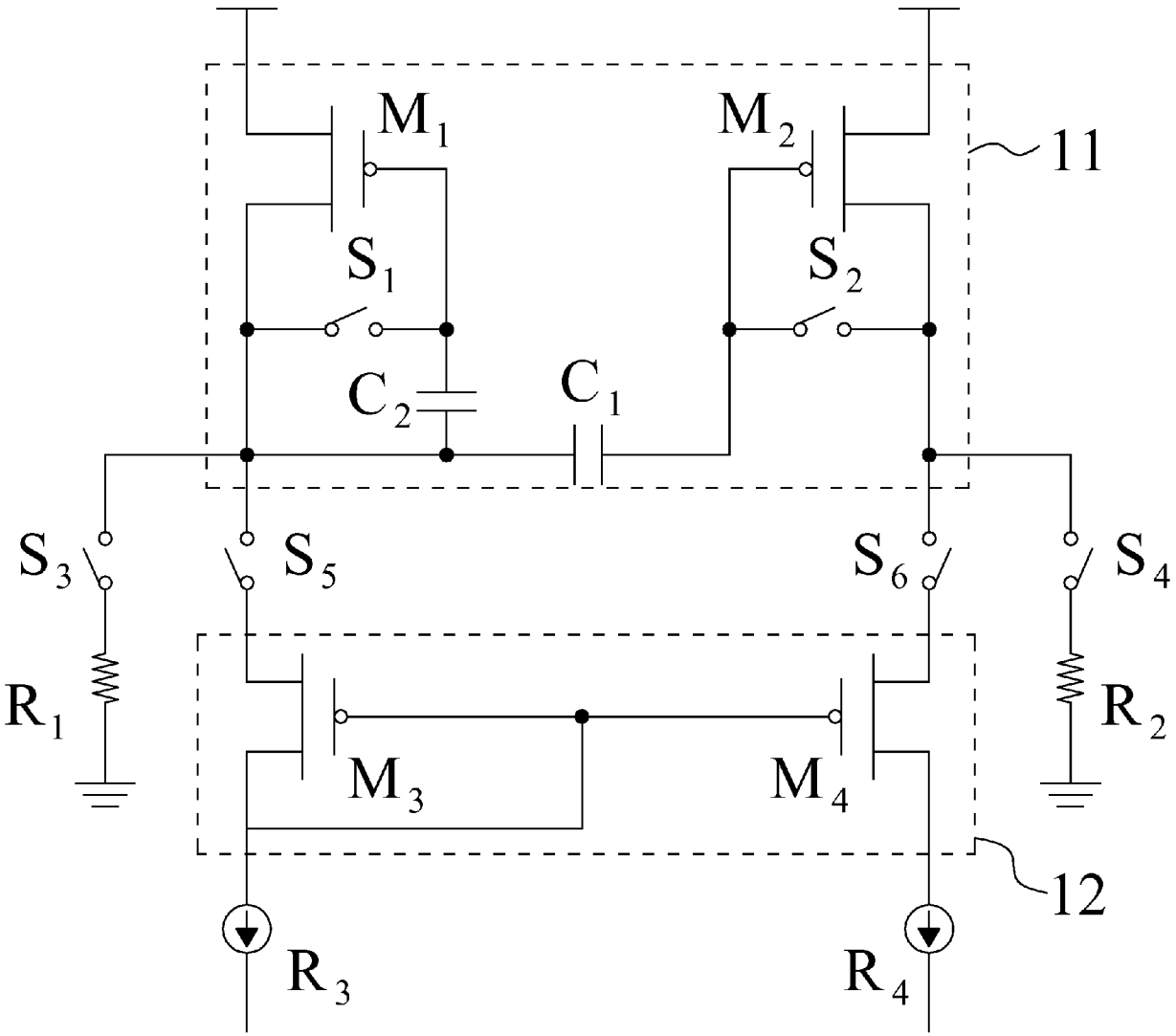
FIG. 2 illustrates a circuit diagram of an offset cancellation current minor in accordance with one embodiment of the present invention.

Referring to FIG. 1 and FIG. 2, a schematic diagram and a circuit diagram of the preferred embodiment of an offset cancellation current mirror according to the present invention are illustrated. In FIG. 1, the offset cancellation current mirror comprises a first minor current 11, a second mirror current 12, a first switch S1, a second switch S2, a third switch 13, a fourth switch 14, a fifth switch 15, a sixth switch 16, a first resistor 17, a second resistor 18, a first load 19 and a second load 20. The third switch 13 and the fourth switch 14 are switched on, and the fifth switch 15 and the sixth switch 16 are switched off in order to connect the first minor current 11 to the first resistor 17 and the second resistor 18 via the third switch 13 and the fourth switch 14. Then the third switch 13 and the fourth switch 14 are switched off, and the fifth switch 15 and sixth switch 16 are switched on in order to connect the first minor current 11 to the second minor current 12 via the fifth switch 15 and sixth switch 16. The first load 19 and the second load 20 are connected to the second mirror current 12 for generating a corresponding current by the first mirror current 11 and the second mirror current 12.

In FIG. 2, the first minor current 11 has a first reference current input terminal, a first reference current output terminal, a first corresponding current input terminal, a first corresponding current output terminal, a first transistor M1, a second transistor M2, a first switch S1, a second switch S2, a first capacitor C1 and a second capacitor C2. The first switch S1 is connected between the gate and the drain of the first transistor M1. The second switch S2 is connected between the gate and the drain of the second transistor M2. The first capacitor C1 is connected between the drain of the first transistor M1 and the gate of the second transistor M2. The second capacitor C2 is connected between the gate and the drain of the first transistor M1. The first reference current input terminal is connected the source of the first transistor M1. The first reference current output terminal is connected to the drain of the first transistor M1. The corresponding current input terminal is connected to the source of the second transistor M2. The first corresponding current input terminal is connected to the drain of the second transistor M2.

The third switch S3 has a first lower access point and a first upper access point connected to the first reference current output terminal. The fourth switch S4 has a second lower access point and a second upper access point connected to the first corresponding current output terminals. The first resistor R1 is connected between the first lower access point of the third switch S3 and a grounding terminal. The second resistor is connected to the second lower access point of the fourth switch S4 and the grounding terminal. The fifth switch S5 has a third lower access point and a third upper access point connected to the first reference current output terminal. The sixth switch S6 has a fourth lower access point and a fourth upper access point connected to the first corresponding current output terminal.

The second current mirror 12 has a second reference current input terminal, a second reference current output terminal, a second corresponding current input terminal, a second corresponding current output terminal, a third transistor M3, and a fourth transistor M4. The gate of the third transistor M3 is connected to the gate of the fourth transistor M4. The gate of the third transistor M3 is connected to the drain of the third transistor M3. The second reference current input terminal is connected to the source of the third transistor M3. The second corresponding current input terminal is connected to the source of the fourth transistor M4. The second reference current input terminal is connected to the third lower access point of the fifth switch S5. The second corresponding current input terminal is connected to the fourth lower access point of the sixth switch S6. The first load R3 is connected to the second reference current output terminal. The second load R4 is connected to the corresponding current output terminal.

When the fifth switch S5 and sixth switch S6 are switched off and the first switch S1, second switch S2, third switch S3 and the fourth switch are switched on at the same time, a reference current is injected into the first transistor M1 and second transistor M2. A potential difference between two nodes of the first capacitor C1 may be generated. The voltage value of the potential difference is the voltage value difference of the gate of the first transistor M1 and the gate of the second transistor M2.

When the switch S5 and sixth switch are switched on, the first switch S1, second switch S2, third switch S3 and fourth switch S4 are switched off; the first current minor 11 is connected to the second current mirror 12 instead of the first resistor R1 and the second resistor R2. The current value of the reference current and current value of the corresponding current is changed corresponding to the connection of the first current minor and the second current mirror, the change of the first load R3 and the change of the load R4. Thus, the voltage of the gate of the first transistor M1 is changed. The second capacitor C2 is connected to the gate of the first transistor M1 and the first capacitor C1 due to the switching off. Thus, the voltage of the first capacitor C1 and the drain of the first transistor M1 are the same. And the potential difference is kept the same.

Figure 3:
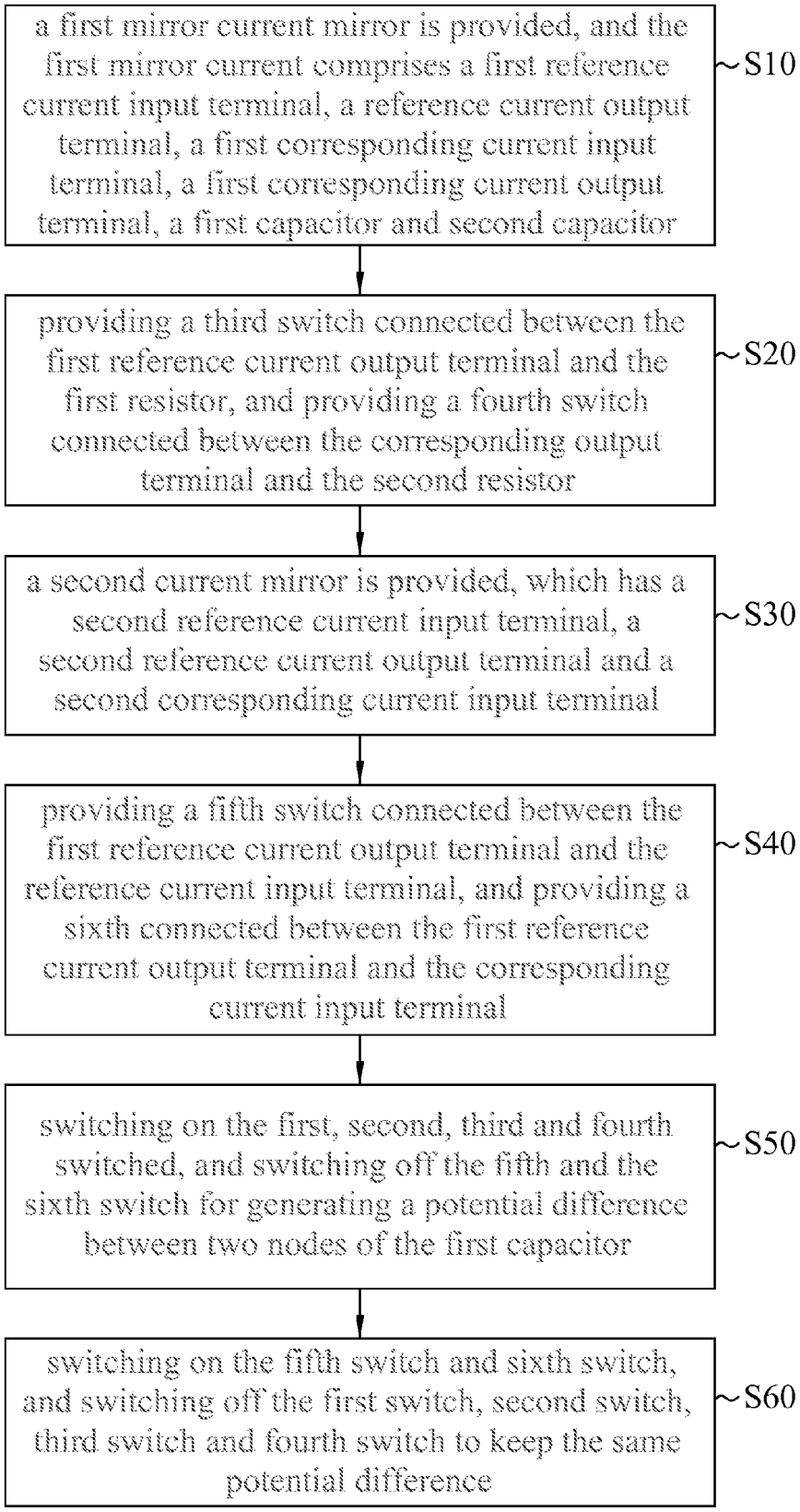
FIG. 3 illustrates a flowchart of an operating method of offset cancellation current minor in accordance with the present invention.

Referring to FIG. 3, a flowchart of an operating method of offset cancellation current minor in accordance with the present invention is illustrated. The operating method of offset cancellation current mirror comprises the step of:

In step S10, a first mirror current mirror is provided, and the first minor current comprises a first reference current input terminal, a reference current output terminal, a first corresponding current input terminal, a first corresponding current output terminal, a first capacitor and second capacitor.

In step S20, a third switch is connected between the first reference current output terminal and the first resistor, and a fourth switch is connected between the corresponding output terminal and the second resistor.

In step S30, a second current minor is provided, which has a second reference current input terminal, a second reference current output terminal and a second corresponding current input terminal.

In the step S40, a fifth switch is provided to be connected between the first reference current output terminal and the reference current input terminal. A sixth is provided to be connected between the first reference current output terminal and the corresponding current input terminal.

In the step S50, the first, second, third and fourth switched is switched on, and the fifth and the sixth switch is switched off for generating a potential difference between two nodes of the first capacitor.

In the step S60, the fifth switch and sixth switch are switched on, and the first switch, second switch, third switch and fourth switch are switched off to keep the same potential difference.

While particular embodiments of the present invention have been shown and described, it will be obvious to those skilled in the art that, based upon the teachings herein, changes and modifications may be made without departing from this invention and its broader aspects. Therefore, the appended claims are intended to encompass within their scope of all such changes and modifications as are within the true spirit and scope of the exemplary embodiment(s) of the present invention.

What is claimed is:

1. An offset cancellation current mirror comprising:

a first current mirror comprising a first reference current input terminal, a first reference current output terminal, a first corresponding current input terminal, a first corresponding current output terminal, a first transistor, a second transistor, a first switch, a second switch, a first capacitor and a second capacitor, the first switch being connected between a gate of the first transistor and a drain of the first transistor, the second switch being connected between a gate of the second transistor and a drain of the second transistor, the first capacitor being connected between the drain of the first transistor and the gate of the second transistor, the second capacitor being connected between the gate of the first transistor and the drain of the first transistor, the source of the first transistor and the drain of the first transistor being connected to the first reference current input terminal and the first reference current output terminal respectively, and the source of the second transistor and the drain of the second transistor being connected to the first corresponding current input terminal and the first corresponding current output terminal respectively;

a third switch comprising a first lower access point and a first upper access point connected to the first reference current output terminal;

a fourth switch comprising a second lower access point and a second upper access point connected to the first corresponding current output terminal;

a first resistor being connected between the first lower access point of the third switch and a grounding terminal;

a second resistor being connected between the second lower access point of the fourth switch and the grounding terminal;

a fifth switch comprising a third lower access point and a third upper access point connected to the first reference current output terminal;

a sixth switch comprising a fourth lower access point and a fourth upper access point connected to the first corresponding current output terminal; and a second current mirror comprising a second reference current input terminal, a second reference current output terminal, a second corresponding current input terminal, a second corresponding current output terminal, a third transistor and a fourth transistor, a gate of the third transistor being connected to a gate of the fourth transistor and a drain of the third transistor, the second reference current input terminal being connected to a source of the third transistor and the third lower access point of the fifth switch, the second corresponding current input terminal being connected to a source of the fourth transistor and the fourth lower access point of the sixth switch.

2. The offset cancellation current mirror of claim 1, wherein, when the fifth switch and the sixth switch are switched off and the first switch, the second switch, the third switch and the fourth switch are switched on, a reference current and a corresponding current are respectively injected into the first transistor and the second transistor to generate a potential difference between two nodes of the first capacitor, and voltage value of the potential difference is a voltage value difference of the gate of the first transistor and the gate of the second transistor.

3. The offset cancellation current mirror of claim 2, wherein, when the fifth switch and the sixth switch are switched on and the first switch, the second switch and the fourth switch are switched off, the first current mirror is connected to the second current mirror instead of the first resistor and the second resistor; the current value of the reference current and the current value of the corresponding is changed corresponding to the connection of the first current mirror and the second current mirror; the second capacitor is connected between the gate of the first transistor and the first capacitor to maintain the same voltage difference value of the first capacitor and the drain of the first transistor; and the potential difference is kept the same.

4. The offset cancellation current mirror of claim 2, wherein voltage value of the potential difference is corresponding to a ratio of the resistance value of the first resistor and the resistance value of the second resistor.

5. The offset cancellation current mirror of claim 1, wherein the first transistor, the second transistor, the third transistor and the fourth transistor are p type MOSFETs.

6. The offset cancellation current mirror of claim 2, wherein the potential difference calibrates the manufacture inaccuracy of the first transistor and the second transistor.

7. An operating method of offset cancellation current mirror, comprising the steps of:

providing a first current mirror comprising a first reference current input terminal, a first reference current output terminal, a first corresponding current input terminal, a first corresponding current output terminal, a first transistor, a second transistor, a first capacitor and a second capacitor, the first switch being connected between a gate of the first transistor and a drain of the first transistor, the second switch being connected between a gate of the second transistor and a drain of the second transistor, the first capacitor being connected between the drain of the first transistor and the gate of the second transistor, the second capacitor being connected between the gate of the first transistor and the drain of the first transistor, the source of the first transistor and the drain of the first transistor being connected to the first reference current input terminal and the first reference current output terminal respectively, and the source of the second transistor and the drain of the second transistor being connected to the first corresponding current input terminal and the first corresponding current output terminal respectively;

providing a third switch connected between the first reference current output terminal and a first resistor, and providing a fourth switch connected between the first corresponding current the a second resistor;

providing a second current mirror comprising a second reference current input terminal, a second reference current output terminal, a second corresponding current input terminal, a second corresponding current output terminal, a third transistor and a fourth transistor, a gate of the third transistor being connected to a gate of the fourth transistor and a drain of the third transistor, the second reference current input terminal being connected to a source of the third transistor, the second corresponding current input terminal being connected to a source of the fourth transistor;

connecting a fifth switch between the first reference current output terminal and the second reference current input terminal, and connecting a sixth switch between the first corresponding current output terminal and the second corresponding current terminal;

switching on the first switch, the second switch, the third switch and the fourth switch and switching off the fifth switch and sixth switch to inject a reference current into the first resistor through the first transistor and to inject a corresponding current into the second resistor through the second transistor for generating a potential difference between two nodes of the first capacitor; and switching on the fifth switch and the sixth switch and switching off the first switch, the second switch, the third switch and the fourth switch to force the reference current flowing through the first transistor and the third transistor and to force the corresponding current flowing through the second transistor and the fourth transistor for maintaining the same voltage difference value of the first capacitor and the drain of the first transistor to keep the same potential difference.

8. The operating method of offset cancellation current mirror of claim 7, further comprising the step of setting a ratio of the resistance value of the first resistor and the resistance value of the second resistor to adjust the potential difference.

9. The operating method of offset cancellation current mirror of claim 7, wherein the first transistor, the second transistor, the third transistor and the fourth transistor are p type MOSFETs.

10. The operating method of offset cancellation current mirror of claim 7, further comprising the step of calibrating the manufacture inaccuracy of the first transistor and the second transistor by the potential difference.

* * * * *